US010968716B2

(12) United States Patent
Zhu et al.

(10) Patent No.: US 10,968,716 B2
(45) Date of Patent: Apr. 6, 2021

(54) WELLHEAD PROFILE WITH INCREASED FATIGUE RESISTANCE

(71) Applicant: Vetco Gray, LLC, Houston, TX (US)

(72) Inventors: Baozhi Zhu, Houston, TX (US); Joseph Pallini, Houston, TX (US)

(73) Assignee: Vetco Gray, LLC, Houston, TX (US)

( * ) Notice: Subject to any disclaimer, the term of this patent is extended or adjusted under 35 U.S.C. 154(b) by 0 days.

(21) Appl. No.: 16/256,590

(22) Filed: Jan. 24, 2019

(65) Prior Publication Data

US 2020/0011147 A1 Jan. 9, 2020

Related U.S. Application Data

(60) Provisional application No. 62/695,660, filed on Jul. 9, 2018.

(51) Int. Cl.
*E21B 33/038* (2006.01)
*E21B 33/037* (2006.01)

(52) U.S. Cl.
CPC ..... *E21B 33/038* (2013.01); *E21B 33/037* (2013.01)

(58) Field of Classification Search
None
See application file for complete search history.

(56) References Cited

U.S. PATENT DOCUMENTS

| | | | | |
|---|---|---|---|---|
| 4,717,183 | A | 1/1988 | Nobileau | |
| 5,505,502 | A | 4/1996 | Smith | |
| 6,030,004 | A | 2/2000 | Schock | |
| 6,494,499 | B1 * | 12/2002 | Galle, Sr. | F16L 15/004 285/334 |
| 6,540,024 | B2 * | 4/2003 | Pallini | E21B 33/038 166/347 |
| 8,668,232 | B2 | 3/2014 | Mazzaferro | |
| 2014/0186107 | A1 | 7/2014 | Hermes | |
| 2017/0183923 | A1 | 6/2017 | Bansal | |
| 2017/0183932 | A1 | 6/2017 | Cotton | |
| 2017/0298698 | A1 | 10/2017 | Branly | |

FOREIGN PATENT DOCUMENTS

WO 2006/092649 9/2006

OTHER PUBLICATIONS

International Search Report and Written Opinion dated Oct. 16, 2019 in corresponding PCT Application No. PCT/US19/40258.

* cited by examiner

*Primary Examiner* — Matthew R Buck
*Assistant Examiner* — Douglas S Wood
(74) *Attorney, Agent, or Firm* — Hogan Lovells US LLP

(57) ABSTRACT

A wellhead includes a wellhead body and a locking end coupled to the wellhead body. The locking end includes an exterior surface with an exterior locking profile. The exterior locking profile includes an exterior groove formed between exterior stab and load flanks on the exterior surface. The locking end also includes an interior surface having an interior locking profile. The interior locking profile includes an interior groove formed between interior stab and load flanks on the interior surface. At least one of the exterior groove or the interior groove is a relief groove that undercuts at least one of the respective stab or load flank. The relief groove corresponds to a portion of the contour of an ellipse intersecting at least a portion of the respective stab or load flank, and an axis of the ellipse is at a tilted angle with respect to an axis of the wellhead.

20 Claims, 3 Drawing Sheets

WELLHEAD PROFILE WITH INCREASED FATIGUE RESISTANCE

CROSS REFERENCE TO RELATED APPLICATIONS

This application claims priority to and the benefit of U.S. Provisional Application Ser. No. 62/695,660 filed Jul. 9, 2018 titled "WELLHEAD PROFILE WITH INCREASED FATIGUE RESISTANT" the full disclosure of which is hereby incorporated herein by reference in its entirety for all purposes.

BACKGROUND

1. Field of Invention

This disclosure relates in general to connections in well assemblies, such as wellhead assemblies and other connection points such as the upper mandrel on a blowout preventer (BOP) stack, among others. In particular, the disclosure relates to a mating profile that provides increased fatigue resistance.

2. Description of the Prior Art

Subsea well systems typically include a tubular wellhead located at the sea floor. During drilling operations, a riser extends from a vessel at the surface down to the wellhead. A wellhead connector connects the lower end of the riser, or a lower marine riser package (LMRP) and BOP, to the wellhead. After the drilling operation, to prepare for production, the riser is disconnected and a similar wellhead connector may be used to connect the subsea production tree to the wellhead. Additionally, a production or workover riser may be connected from a floating vessel. In either setup, the wellhead connector mates with the wellhead via an interface between the two. In some cases, the wellhead connector has a housing which slides over the wellhead to securely mate with the wellhead. The wellhead connector may include a plurality of dogs that surround the wellhead profile and a cam ring which may urge the dogs inward onto the wellhead, thereby engaging and locking the wellhead connector onto the wellhead.

Subsea systems may be subject to various forces, which cause stress and fatigue to the connection between the wellhead and the wellhead connector. Over time, such stress and fatigue may cause the connection to fail.

SUMMARY

Applicant recognized the problems noted above and conceived and developed embodiments for wellhead profiles with increased fatigue resistance.

In an example embodiment, a wellhead includes a wellhead body and a cylindrical locking end coupled to the wellhead body for locking onto a wellhead connector. The locking end includes an exterior surface comprising an exterior locking profile. The exterior locking profile comprising an exterior groove formed between exterior stab and load flanks on the exterior surface. The locking end also includes an interior surface comprising an interior locking profile. The interior locking profile comprising an interior groove formed between interior stab and load flanks on the interior surface. At least one of the exterior groove or the interior groove is a relief groove that undercuts at least one of the respective stab or load flank.

In certain such embodiments, the exterior groove includes the relief groove that undercuts the load flank on the exterior surface. In some embodiments, the interior groove includes the relief groove that undercuts the load flank on the interior surface. In some embodiments, the relief groove corresponds to a portion of the contour of an ellipse intersecting at least a portion of the respective stab or load flank. In some embodiments, an axis of the ellipse is aligned with an axis of the wellhead. In some embodiments, an axis of the ellipse is at an angle with respect an axis of the wellhead. In some embodiments, the relief groove includes 10% to 50% of the contour of the ellipse.

In accordance with another example embodiment, a wellhead includes a wellhead body and a locking end coupled to the wellhead body for locking onto a wellhead connector. The locking end includes a cylindrical surface includes a locking profile. The locking profile includes a stab flank, a load flank, and a groove formed between the stab flank and the load flank on the cylindrical surface, in which the groove undercuts at least one of the stab flank or load flank.

In certain such embodiments, the groove corresponds to a portion of the contour of an ellipse intersecting at least a portion of the stab flank or load flank. In some embodiments, an axis of the ellipse is aligned with an axis of the wellhead. In some embodiments, an axis of the ellipse is at a tilted angle with respect an axis of the wellhead. In some embodiments, the groove includes 10% to 50% of the contour of the ellipse. In some embodiments, the groove is a first groove and the ellipse is a first ellipse, and wherein the locking profile further comprises a second groove adjacent the first groove, wherein the second groove corresponds to a portion of the contour of the second ellipse, the second ellipse overlapping with the first ellipse.

In accordance with another example embodiment, a wellhead system includes a wellhead connector comprising a plurality of dogs with grooves formed on an interior surface, and a wellhead comprising a locking end for locking onto the wellhead connector. The locking end includes a cylindrical surface having a locking profile for engaging with the grooves in the wellhead connector. The locking profile includes relief grooves formed between stab flanks and the load flanks on the cylindrical surface, in which the relief grooves undercut at least one of a neighboring stab flank or load flank.

In certain such embodiments, the relief grooves correspond to respective ellipses intersecting respective neighboring stab flanks or load flanks. In some embodiments, at least a portion of the ellipses have different sizes, angles, or positions relative to the wellhead. In some embodiments, an axis of at least one of the ellipses is aligned with an axis of the wellhead. In some embodiments, an axis of at least one of the ellipses is at a tilted angle with respect to an axis of the wellhead. In some embodiments, the relief grooves include 10% to 50% of the contour of the corresponding ellipses. In some embodiments, two of the relief grooves are adjacent and the ellipses corresponding to the two relief grooves overlap each other.

BRIEF DESCRIPTION OF THE DRAWINGS

The present technology will be better understood on reading the following detailed description of non-limiting embodiments thereof, and on examining the accompanying drawings, in which.

DETAILED DESCRIPTION OF THE INVENTION

Figure 1:
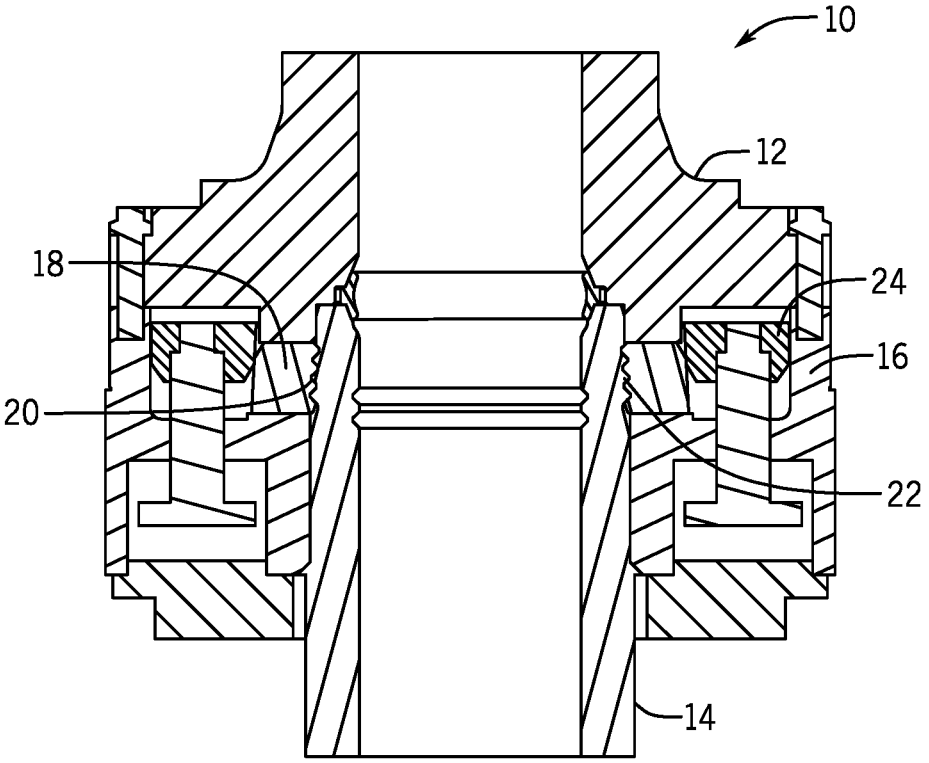
FIG. 1 is a cross-sectional view of a wellhead connector positioned on a wellhead, in accordance with an example embodiment of the present technology.

The foregoing aspects, features and advantages of the present technology will be further appreciated when considered with reference to the following description of preferred embodiments and accompanying drawings, wherein like reference numerals represent like elements. In describing the preferred embodiments of the technology illustrated in the appended drawings, specific terminology will be used for the sake of clarity. The present technology, however, is not intended to be limited to the specific terms used, and it is to be understood that each specific term includes equivalents that operate in a similar manner to accomplish a similar purpose. For example, the term "ellipse" may be used herein to describe generally various curvatures of the relief groove profile, and is not limited to curvatures that follow a perfect elliptical shape. For example, an "elliptical" profile, shape, or curvature may be used to describe any type of curvature, including but not limited to that of a circle, and those not defined by a geometric shape.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Any examples of operating parameters and/or environmental conditions are not exclusive of other parameters/conditions of the disclosed embodiments. Additionally, it should be understood that references to "one embodiment", "an embodiment", "certain embodiments," or "other embodiments" of the present invention are not intended to be interpreted as excluding the existence of additional embodiments that also incorporate the recited features. Furthermore, reference to terms such as "above," "below," "upper", "lower", "side", "front," "back," or other terms regarding orientation are made with reference to the illustrated embodiments and are not intended to be limiting or exclude other orientations.

FIG. 1 is a cross-sectional view 10 of a wellhead connector 12 positioned on a wellhead 14, in accordance with an embodiment of the present technology. Subsea well systems typically include a tubular wellhead located at the sea floor. During drilling operations as well as other various operations or equipment configurations, a riser (not shown) extends from a vessel at the surface down to the wellhead 14. A wellhead connector 12 connects the lower end of the riser to the wellhead 14. After the drilling operation, to prepare for production, the riser is disconnected and a similar wellhead connector may be used to connect the subsea production tree or production risers to the wellhead. In either setup, the wellhead connector 12 mates with the wellhead 14 via an interface between the two. In some cases, the wellhead connector 12 has a housing 16 which slides over the wellhead 14 and includes a plurality of dogs 18 with a plurality of grooves 20 formed on the interior surface. The wellhead 14 also includes a similar plurality of grooves 22 formed on the exterior of the wellhead 14 which mate complementarily with the grooves 20 on the wellhead connector 12. In some embodiments, a cam ring 24 on the wellhead connector 12 may urge the dogs 18 inward onto the wellhead 14, thereby engaging and locking the wellhead connector 12 onto the wellhead 14 via the grooves 20, 22.

Subsea systems may be subject to various forces. For example, tides may pull on a riser, which may pull on the connection at the wellhead connector. This may cause stress and fatigue to the connection between the wellhead and the wellhead connector. Over time, such stress and fatigue may cause the connection to fail. The present disclosure provides a wellhead locking profile between the wellhead and the wellhead connector that is more fatigue resistant and robust than the conventional profile.

Figure 2:
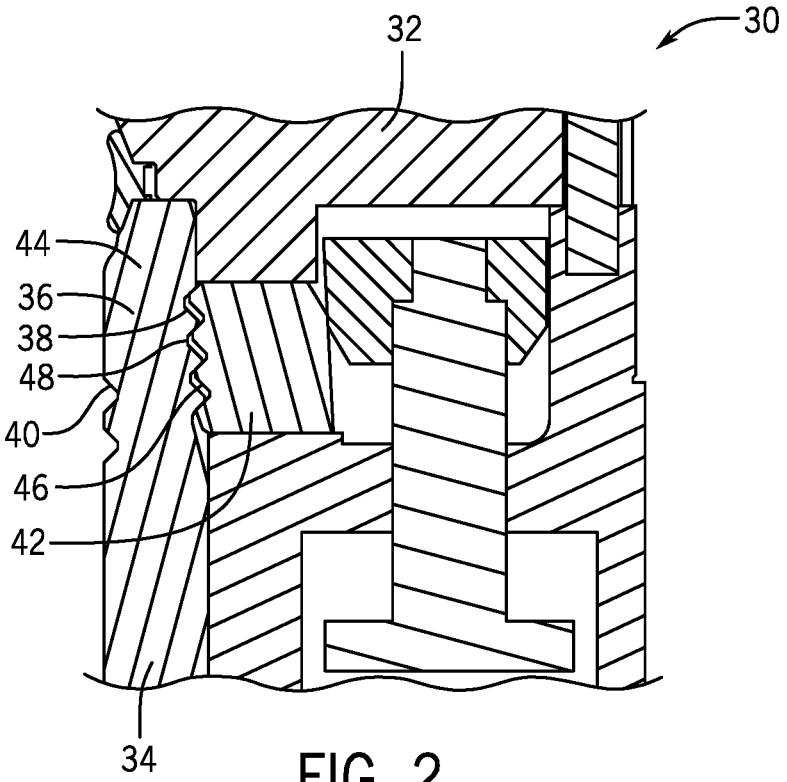
FIG. 2 is a partial cross-sectional view of a wellhead connector positioned on a wellhead with an enhanced wellhead profile, in accordance with an example embodiment of the present technology.

FIG. 2 is a partial cross-sectional view of a wellhead system 30 with a wellhead connector 32 positioned on a wellhead 34 with an enhanced wellhead locking profile 36, in accordance with an embodiment of the present technology. The wellhead 34 may include a locking end 44 for locking onto the wellhead connector 32. In some embodiments, the enhanced wellhead locking profile 36 may include an external wellhead profile 38 and an internal wellhead profile 40. Either or both of the external 38 or internal profiles 40 may include the enhanced wellhead profile configuration. As mentioned, the wellhead system 30 includes a wellhead connector 32 comprising a plurality of dogs 42 with grooves 46 formed on an interior surface. The locking end 44 includes a cylindrical surface having the locking profile 36 for engaging with the grooves 46 in the wellhead connector 32. The locking profile 36 includes one or more relief grooves 48 formed between the stab flanks and the load flanks on the cylindrical surface, in which the relief grooves undercut at least one of a neighboring stab flank or load flank, or both. Such features are illustrated and described in further detail with respect to FIGS. 3A and 3B below.

Figure 3B:
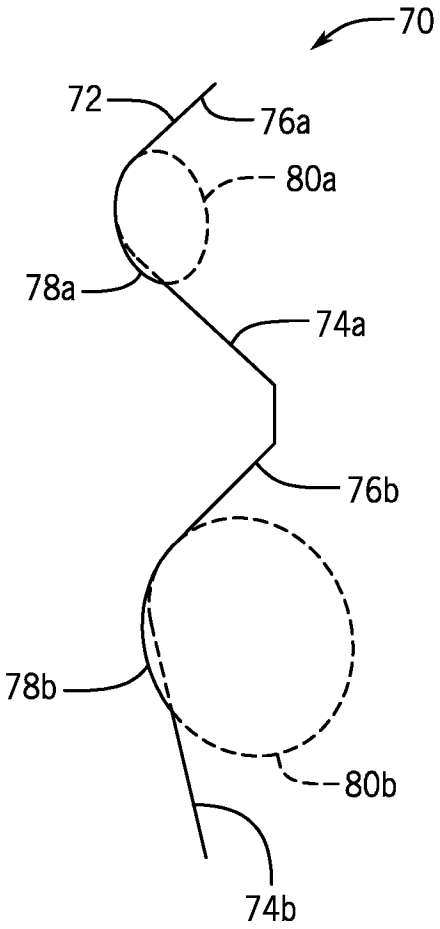
FIG. 3B is a detailed illustration of the enhanced wellhead profile, in accordance with an example embodiment of the present technology.
Figure 3A:
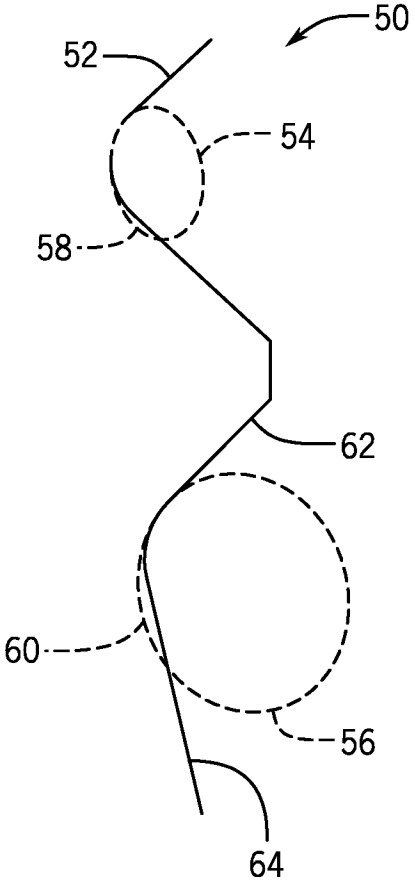
FIG. 3A is a detailed illustration of a conventional wellhead profile relative to an enhanced wellhead profile, in accordance with an example embodiment of the present technology.

FIG. 3A is a detailed illustration 50 of a portion of a conventional wellhead profile relative to an enhanced conventional wellhead profile, in accordance with an embodiment of the present technology. Specifically, the continuous line 52 represents the conventional wellhead profile and the ellipses 54, 56 illustrate changes to the conventional groove configuration to obtain the enhanced wellhead profile. As illustrated, the conventional grooves are substantially tangential to the stab flanks and load flanks on either side of the grooves, and are formed following the natural convergence angle of the stab flanks and load flanks.

In contrast, the elliptical relief grooves of the enhanced profile cuts into sides of where the conventional grooves would be to create a smoother and more gradual curvature transition. As illustrated, the elliptical relief grooves are wider and/or deeper than the conventional grooves. This gradual curvature transition reduces the peak stress and which makes the wellhead profile more fatigue resistant. In some embodiments, as shown by relief groove type one 58 (formed by ellipse 54) in FIG. 3A, the focal point of the ellipse may be lower than the focal point of the conventional groove configuration. This allows for a larger curvature by undercutting more from the stab flank where there is typically less concern over losing bearing. In some embodiments, a relief groove 60 is formed as a portion of an ellipse 56 placed at an angle relative to an axis of the wellhead 34 and partially undercuts the existing load and stab flanks 62, 64 illustrated as groove type two 60 in FIG. 3A. This allows for a larger elliptical relief, and when the stab flank 64 is at a shallower angle, such as the bottom groove 60, smoother transitional curvature can be achieved without excessively adding/removing materials. By tilting the ellipse 56, the stress is redirected to a lower location and allows for a larger, smoother curvature to be fit into the space, providing for increased fatigue resistance.

The enhanced wellhead profile includes one or more relief grooves formed therein, in which the existing root radii of the natural groove is replaced with elliptical relief grooves 58, 60 that extend into and undercut the load and stab flanks 62, 64 and thereby provide for reduced fatigue stress. The ellipses 54, 56 by which the relief grooves 58, 60 are formed are illustrated in FIG. 3A. The relief grooves 58, 60 have a shape corresponding to at least a portion of the ellipses 54, 56 respectively. In some embodiments, a relief groove 58 is shaped as a portion of an upright ellipse 54, as illustrated in groove type one 58, or a tilted ellipse 56 as illustrated in groove type two 60 in FIG. 3A.

In various embodiments, the elliptical relief grooves 58, 60 may be shaped according to the contour of various different ellipse configurations, including ellipses of different sizes, height to width ratios, and tilt angles. FIG. 3A illustrates two ellipses 54, 56 of different sizes and tilt angles. The particular configuration of the elliptical relief grooves 58, 60 may be determined based on parameters of the wellhead 34, the type of wellhead connector 32 to be used, among other possible factors. The elliptical relief grooves 58, 60 may also be shaped or configured according to different portions of the outer contour of an ellipse. For example, in one embodiment, an elliptical relief groove may include 25% of the contour of an ellipse. For example, in another embodiment, an elliptical relief groove may include 33% of the contour of an ellipse.

FIG. 3B is a detailed illustration 70 of a portion of an enhanced wellhead profile 72. The solid line represents the enhanced wellhead profile 72. In some embodiments, the enhanced wellhead profile may be a cylindrical surface and include a first relief groove 78*a* and a second relief groove 78*b*. Each relief groove may be positioned between respective a respective stab flank 74*a*, 74*b*, and a respective load flank 76*a*, 76*b*, in which the relief grooves 78*a*, 78*b* undercut at least one of the respective stab flank 74*a*, 74*b*, or load flank 76*a*, 76*b*, or both. In FIG. 3B, dotted lines illustrate where the stab flanks 74*a*, 74*b*, load flanks 76*a*, 76*b* would otherwise extend. This illustrates where the stab flanks 74*a*, 74*b*, load flanks 76*a*, 76*b* were undercut by the relief grooves 78*a*, 78*b*. In contrast, the conventional grooves illustrated in FIG. 3A do not undercut, but rather are tangential to, the stab flanks and load flanks. This undercutting allows for grooves with larger elliptical shape that could not be formed following the natural groove formed by the convergence of the stab flanks and load flanks illustrated in FIG. 3A. The enhanced wellhead profile provided in the present disclosure provides for different and better performance than conventional wellhead profiles due at least in part to the unconventional shape and orientation of the relief groove, undercutting the stab and load flanks, which allows for the stress to be is redirect to a lower location away from more vulnerable parts of the wellhead.

In certain such embodiments, the first relief groove 78*a* corresponds to a portion of the contour of a first ellipse 80*a* intersecting at least a portion of the respective stab flank 74*a* or load flank 76*a*, or both. Similarly, the second relief groove 78*a* corresponds to a portion of the contour of a second ellipse 80*a* intersecting at least a portion of the respective stab flank 74*a* or load flank 76*a*, or both. As illustrated, the first ellipse 80*a*, from which the first relief groove 78*a* is formed, has an axis aligned with an axis of the wellhead. Thus, the first ellipse 80*a* is positioned upright with respect to the axis of the wellhead. The second ellipse 80*b*, from which the second relief groove 78*b* is formed, has an axis at an angle with respect to the axis of the wellhead. Thus, the second ellipse 80*b* is positioned at a tilted angle with respect to the axis of the wellhead. In some embodiments, the relief grooves may include 10% to 50% of the contour of the ellipse. In some other embodiments, a relief groove may include more or less of the contour of an ellipse. In some embodiments, some of the ellipses may have various different sizes, angles, or positions relative to the wellhead. In some embodiments, not all of the grooves on a wellhead profile are the relief grooves provided herein, and there may be a mix of the relief grooves and conventional grooves.

In some embodiments, the relief grooves formed from the ellipses may be able to achieve 10%-20% reduction of the fatigue inducing stress with minimal impact on the structural behavior. The stress gradient along the grooves is lowered, and the peak stress is reduced by 10%-20% depending on the individual connectors mated to the wellhead profile. Because of the subtlety of the angled relief grooves, the structural behavior impact may be minimal, including but not limited to the preload, system stiffness, and the load bearing capacities at the interface. The elliptical profile may be retrofitted to existing wellheads and does not change the interface with existing wellhead connectors.

Figure 4:
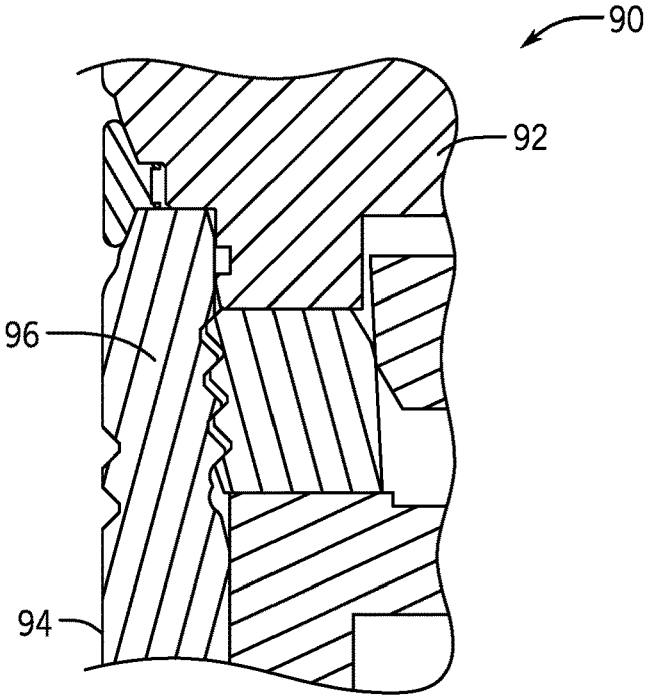
FIG. 4 is a partial cross-sectional view of a wellhead connector positioned on a wellhead with another embodiment of an enhanced wellhead profile, in accordance with an example embodiment of the present technology.
Figure 5:
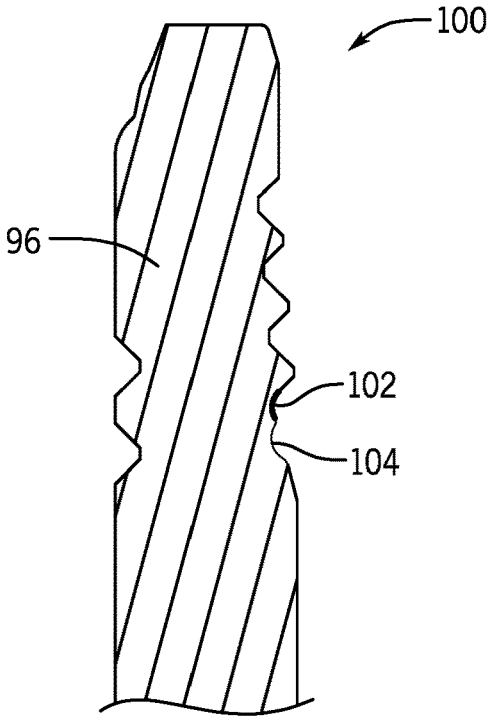
FIG. 5 is a detailed illustration of the enhanced wellhead profile of FIG. 4, in accordance with an example embodiment of the present technology.

FIG. 4 is a partial cross-sectional view 90 of a wellhead connector 92 positioned on a wellhead 94 with another embodiment of an enhanced wellhead profile 96, in accordance with an embodiment of the present technology. FIG. 5 is a detailed illustration 100 of the enhanced wellhead profile 96 of FIG. 4, in accordance with an embodiment of the present technology. Referring to FIGS. 4 and 5, another embodiment of an enhanced wellhead profile includes two adjacent elliptical relief grooves 102, 104. Adding a second ellipse groove 104 directly under a first ellipse groove 102 helps to further reduce the stress in the region by disrupting and redistributing the stress flow and thus further reducing the fatigue stress. In some embodiments, each of the two adjacent elliptical relief grooves 102, 104 may undercut at least one neighboring stab or load flank. In some embodiments, each of the two adjacent elliptical relief grooves 102, 104 may also correspond to an ellipse, in which each ellipse intersects with the at least one neighboring stab or load flank. The two ellipses may also intersect or overlap with each other. In some embodiments, the two adjacent elliptical relief grooves 102, 104 may be positioned at the base of the locking profile 96.

In some embodiments, the first and second relief grooves 102, 104 have the same configuration, such as having the same ellipse size and orientation. In some embodiments, the first and second ellipse relief grooves 102, 104 may have different configurations, such having different ellipse sizes, different tilt angles, and/or different amounts of the ellipse contour. In some embodiments, more than two adjacent elliptical relief grooves may be used. The number of elliptical relief grooves, and size and orientation of the elliptical relief grooves may be selected based on the parameters of the wellhead and wellhead assembly among other contribution design factors. The elliptical relief grooves described herein may be used in both the external wellhead profile and/or the internal wellhead profile.

Although the technology herein has been described with reference to particular embodiments, it is to be understood that these embodiments are merely illustrative of the principles and applications of the present technology. It is therefore to be understood that numerous modifications may be made to the illustrative embodiments and that other arrangements may be devised without departing from the spirit and scope of the present technology as defined by the appended claims.

The invention claimed is:

1. A wellhead, comprising:

a wellhead body; and a cylindrical locking end coupled to the wellhead body for locking onto a wellhead connector, the locking end comprising:

an exterior surface comprising an exterior locking profile, the exterior locking profile comprising an exterior groove formed between exterior stab and load flanks on the exterior surface; and an interior surface comprising an interior locking profile, the interior locking profile comprising an interior groove formed between interior stab and load flanks on the interior surface, wherein at least one of the exterior groove or the interior groove is a relief groove that undercuts at least one of the respective stab or load flank, a contour of the relief groove being non-tangential to at least one of the respective stab or load flank.

2. The wellhead system of claim 1, wherein the exterior groove includes the relief groove that undercuts the load flank on the exterior surface.

3. The wellhead system of claim 1, wherein the interior groove includes the relief groove that undercuts the load flank on the interior surface.

4. The wellhead system of claim 1, wherein the relief groove includes 10% to 50% of the contour of an ellipse.

5. The wellhead system of claim 1, wherein the locking end comprises two adjacent relief grooves.

6. The wellhead system of claim 5, wherein the two adjacent relief grooves have different sizes, angles, or positions relative to the wellhead.

7. A wellhead, comprising:

a wellhead body; and a locking end coupled to the wellhead body for locking onto a wellhead connector, the locking end comprising a locking profile, the locking profile comprising:

a stab flank;

a load flank;

a first relief groove formed between the stab flank and the load flank on the cylindrical surface, wherein the first relief groove undercuts at least one of the stab flank or load flank and corresponds to a portion of the contour of an ellipse non-tangential to and intersecting at least a portion of the stab flank or load flank; and a second relief groove adjacent the first relief groove, wherein the second relief groove has a curvature non-tangential to and intersecting at least a portion of the stab flank or load flank.

8. The wellhead of claim 7, wherein the locking end comprises an exterior surface and an interior surface, and the locking profile is formed on the exterior surface or the interior surface.

9. The wellhead of claim 7, wherein an axis of the ellipse is aligned with an axis of the wellhead.

10. The wellhead of claim 7, wherein an axis of the ellipse is at a tilted angle with respect to an axis of the wellhead.

11. The wellhead of claim 7, wherein the relief groove includes 10% to 50% of the contour of the ellipse.

12. The wellhead of claim 7, wherein the second relief groove corresponds to a portion of the contour of a second ellipse, the second ellipse overlapping with the ellipse of the first relief groove.

13. A wellhead system, comprising:

a wellhead connector comprising a plurality of dogs with grooves formed on an interior surface;

a wellhead comprising a locking end for locking onto the wellhead connector, the locking end comprising a locking profile, the locking profile comprising:

a stab flank;

a load flank; and a relief groove formed between the stab flank and the load flank on the cylindrical surface, wherein the relief groove undercuts at least one of the stab flank or load flank, a contour of the relief groove being non-tangential to at least one of the respective stab or load flank.

14. The wellhead system of claim 13, wherein the locking end comprises an exterior surface and an interior surface, and the locking profile is formed on the exterior surface.

15. The wellhead system of claim 13, wherein the locking end comprises an exterior surface and an interior surface, and the locking profile is formed on the interior surface.

16. The wellhead system of claim 13, wherein the relief grooves include 10% to 50% of the contour of an ellipse.

17. The wellhead system of claim 14, wherein the locking profile comprises a first relief groove and a second relieve groove adjacent the first relief groove.

18. The wellhead system of claim 17, wherein the second relieve groove corresponds to a portion of the contour of a second ellipse, the second ellipse intersecting the ellipse of the first relief groove.

19. The wellhead system of claim 17, wherein the two adjacent relief grooves have different sizes, angles, or positions relative to the wellhead.

20. The wellhead system of claim 13, wherein one or more of the plurality of dogs of the wellhead connector engage with the relieve groove.

* * * * *